US012686426B2

(12) United States Patent
Hogan

(10) Patent No.: US 12,686,426 B2
(45) Date of Patent: Jul. 21, 2026

(54) CROSSING GATE MECHANISM WITH INTEGRATED POSITION DETECTION AND ANGLE MEASUREMENT

(71) Applicant: Siemens Mobility, Inc., New York, NY (US)

(72) Inventor: Brian Joseph Hogan, Temecula, CA (US)

(73) Assignee: Siemens Mobility, Inc., New York, NY (US)

( * ) Notice: Subject to any disclaimer, the term of this patent is extended or adjusted under 35 U.S.C. 154(b) by 609 days.

(21) Appl. No.: 18/193,949

(22) Filed: Mar. 31, 2023

(65) Prior Publication Data

US 2024/0326884 A1 Oct. 3, 2024

(51) Int. Cl.
*B61L 29/16* (2006.01)
*B61L 29/04* (2006.01)

(52) U.S. Cl.
CPC ..... *B61L 29/16* (2013.01); *B61L 29/04* (2013.01)

(58) Field of Classification Search
CPC ..... B61L 29/04; B61L 29/16
See application file for complete search history.

(56) References Cited

U.S. PATENT DOCUMENTS

2022/0194442 A1 6/2022 Ibarra et al.

FOREIGN PATENT DOCUMENTS

WO WO-2019199310 A1 * 10/2019 ..... B61L 29/04

* cited by examiner

*Primary Examiner* — Robert J McCarry, Jr.

(57) ABSTRACT

A crossing gate mechanism includes an enclosure housing multiple components including a control unit configured to operate the crossing gate mechanism and associated crossing gate arm, an electric motor driving a main shaft, the main shaft extending outside the enclosure and the crossing gate arm being coupled to the main shaft, one or more electronic sensor(s) capable of providing angular information, and a processing unit configured to determine positions based on the angular information.

15 Claims, 3 Drawing Sheets

CROSSING GATE MECHANISM WITH INTEGRATED POSITION DETECTION AND ANGLE MEASUREMENT

BACKGROUND

1. Field

Aspects of the present disclosure generally relate to railroad crossing gates and crossing gate mechanisms, more particularly, to a crossing gate mechanism with integrated position detection and angle measurement.

2. Description of the Related Art

A railway crossing, also referred to as level crossing or grade crossing, is an intersection where a railway line crosses a road or path. To ensure safety of railway crossings, crossing control systems including signal control equipment are installed at railway crossings. Railroad signal control equipment includes for example a constant warning time device, also referred to as a grade crossing predictor (GCP) in the U.S. or a level crossing predictor in the U.K., which is an electronic device that is connected to rails of a railroad track and is configured to detect the presence of an approaching train and determine its speed and distance from a crossing, i.e., a location at which the tracks cross a road, sidewalk or other surface used by moving objects. The constant warning time device will use this information to generate a constant warning time signal for a crossing warning device.

A crossing warning device is a device that warns of the approach of a train at a crossing, examples of which include crossing gate arms, crossing lights (such as the red flashing lights often found at highway grade crossings in conjunction with the crossing gate arms), and/or crossing bells or other audio alarm devices. Constant warning time devices are typically configured to activate the crossing warning device(s) at a fixed time, also referred to as warning time (WT), which can be for example 30 seconds, prior to the approaching train arriving at the crossing.

Railroad crossing gates utilize electrical and mechanical components to ensure that the crossing gates perform their intended functions correctly. For example, gate arms are lowered using a motor located in a crossing gate mechanism, herein also referred to as gate control mechanism. A crossing gate mechanism may be described as gate control box housing multiple mechanical, electric and electronic components for operating and controlling the signal control equipment and warning devices, such as the crossing gates.

SUMMARY

Briefly described, aspects of the present disclosure generally relate to railroad crossing gates and, more particularly to a crossing gate mechanism with integrated position detection and angle measurement.

A first aspect of the present disclosure provides a crossing gate mechanism comprising an enclosure housing multiple components including a control unit configured to operate the crossing gate mechanism and associated crossing gate arm, an electric motor driving a main shaft, the main shaft extending outside the enclosure and the crossing gate arm being coupled to the main shaft, at least one electronic sensor capable of providing angular information, and a processing unit configured to determine positions based on the angular information.

A second aspect of the present disclosure provides a crossing gate system comprising one or more crossing gate arm(s), and a crossing gate mechanism as described herein.

DETAILED DESCRIPTION

To facilitate an understanding of embodiments, principles, and features of the present disclosure, they are explained hereinafter with reference to implementation in illustrative embodiments. In particular, they are described in the context of a crossing gate mechanism utilized in connection with railroad crossing gate applications.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
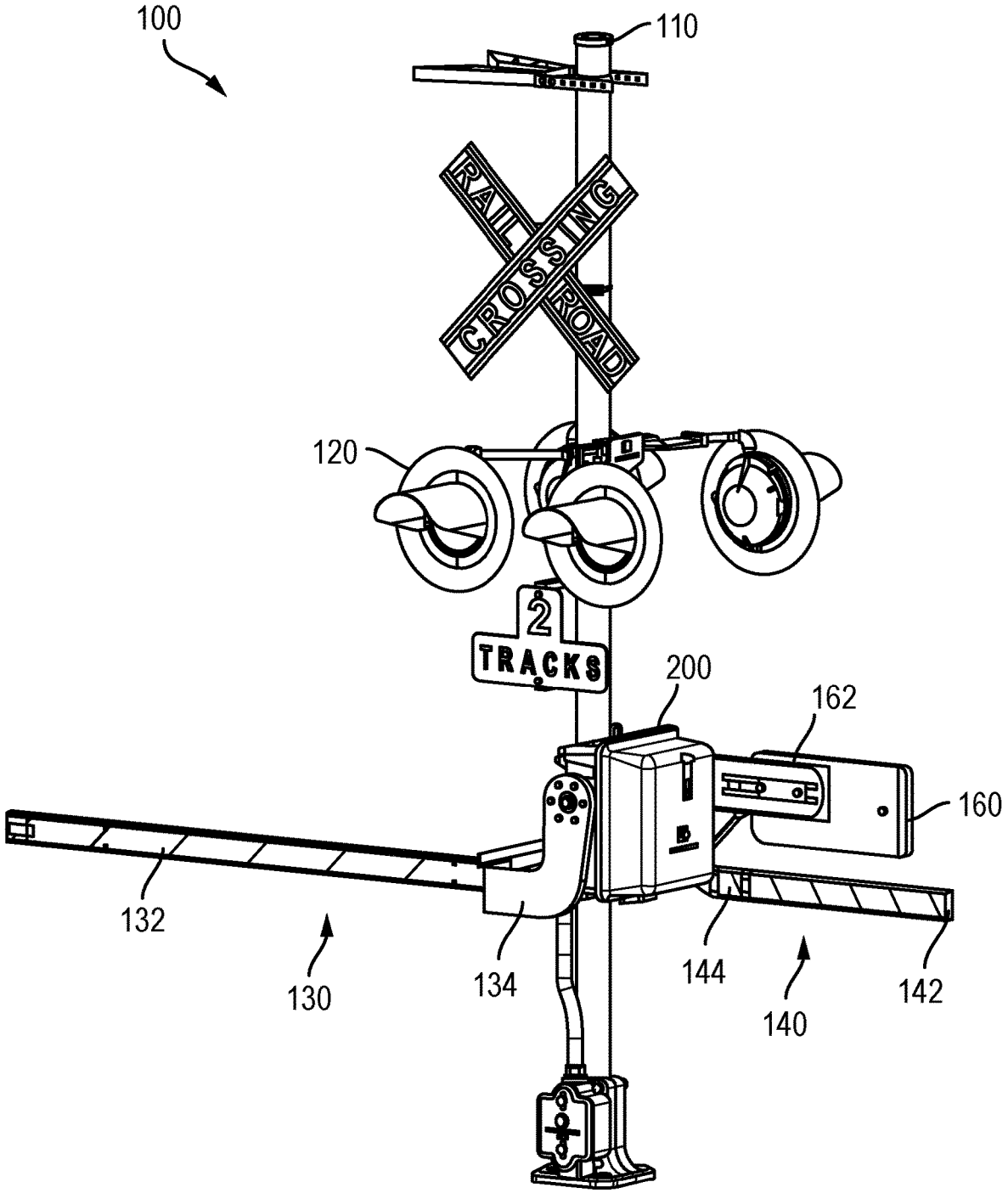
FIG. 1 illustrates an example railroad crossing gate in accordance with an exemplary embodiment of the present disclosure.

FIG. 1 illustrates a railroad crossing gate 100 in a lowered or horizontal position. At many railroad crossings, at least one railroad crossing gate 100 may be placed on either side of the railroad track to restrict roadway traffic in both directions. At some crossings, pedestrian paths or sidewalks may run parallel to the roadway. To restrict road and sidewalk traffic, the illustrated railroad crossing gate 100 includes a separate roadway gate 130 and pedestrian gate 140. The roadway gate 130 and pedestrian gate 140 may be raised and lowered, i. e. operated, by control mechanism 200.

The example railroad crossing gate 100 also includes a pole 110 and signal lights 120. The gate control mechanism 200 is attached to the pole 110 and is used to raise and lower the roadway and pedestrian gates 130, 140. The illustrated railroad crossing gate 100 is often referred to as a combined crossing gate. When a train approaches the crossing, the railroad crossing gate 100 may provide a visual warning using the signal lights 120. The gate control mechanism 200 will lower the roadway gate 130 and the pedestrian gate 140 to respectively restrict traffic and pedestrians from crossing the track until the train has passed.

As shown in FIG. 1, the roadway gate 130 comprises a roadway gate support arm 134 that attaches a roadway gate arm 132 to the gate control mechanism 200. Similarly, the pedestrian gate 140 comprises a pedestrian gate support arm 144 connecting a pedestrian gate arm 142 to the gate control mechanism 200. When raised, the gates 130 and 140 are positioned so that they do not interfere with either roadway or pedestrian traffic. This position is often referred to as the vertical position. A counterweight 160 is connected to a counterweight support arm 162 connected to the gate control mechanism 200 to counterbalance the roadway gate arm 132.

Typically, the gates 130, 140 are lowered from the vertical position using an electric motor contained within the gate control mechanism 200. The electric motor drives gearing connected to shafts (not shown) connected to the roadway gate support arm 134 and pedestrian gate support arm 144. The support arms 134, 144 are usually driven part of the way down by the motor (e.g., somewhere between 70 and 45 degrees) and then gravity and momentum are allowed to bring the arms 132, 142 and the support arms 134, 144 to the horizontal position. In another example, the support arms 134, 144 are driven all the way down to the horizontal position by the electric motor of the gate control mechanism 200.

Figure 2:
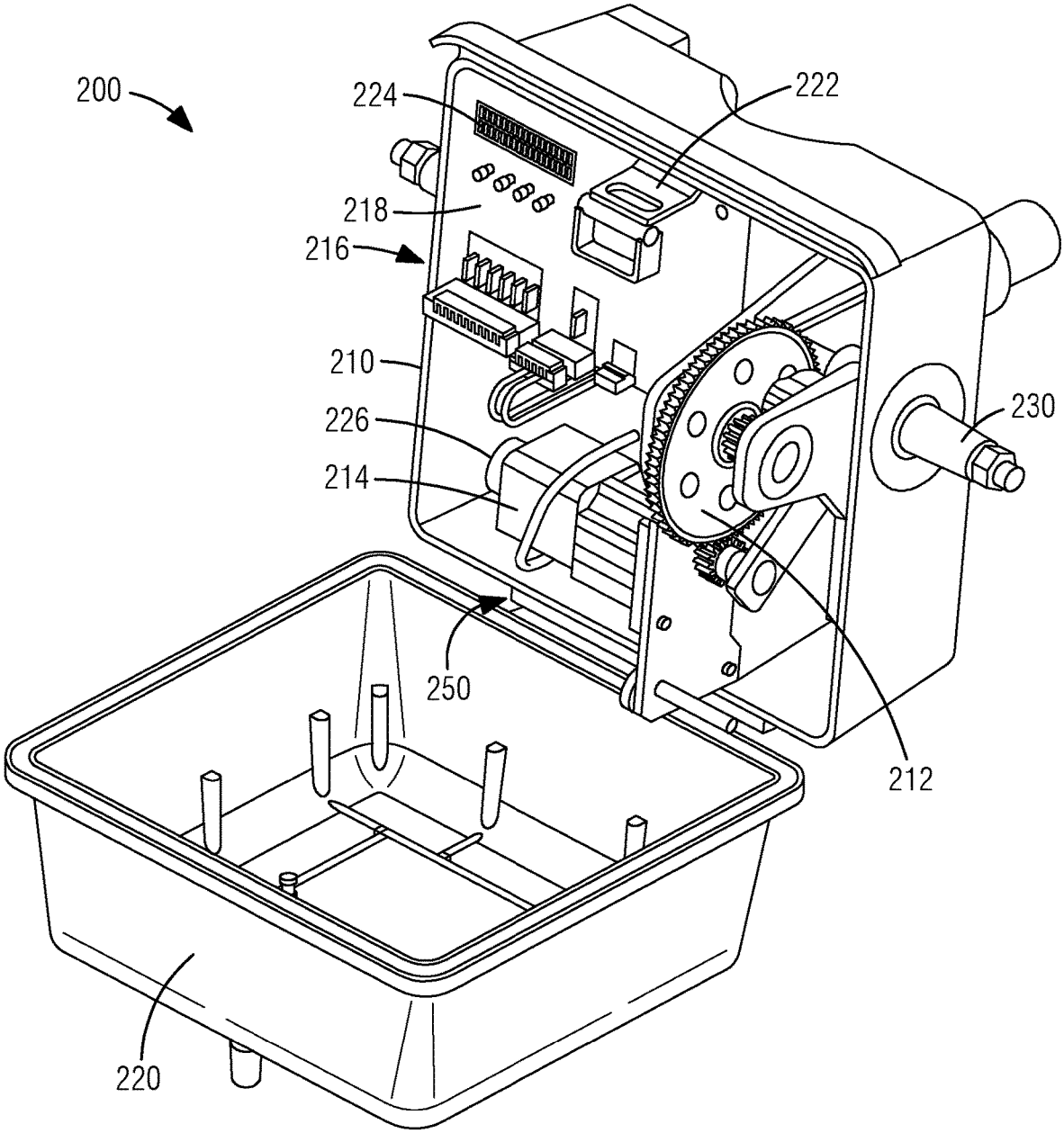
FIG. 2 illustrates a perspective view of a crossing gate mechanism in accordance with an exemplary embodiment of the present disclosure.

FIG. 2 illustrates a perspective view of crossing gate mechanism 200 in accordance with an exemplary embodiment of the present disclosure.

The crossing gate mechanism 200 comprises an enclosure 210 housing multiple mechanical, electrical, and electronic components, such as for example gearing 212, electric motor 214 driving the gearing 212, electric brake 226 and control unit 216. The electric motor 214 can be a gearmotor and can be a brushless direct current (DC) motor.

The electric motor 214 and gearing 212 are configured to drive main shaft 230. The main shaft 230 extends outside the gate mechanism 200, i. e. enclosure 210. The gate support arm 134 (see FIG. 1) is fixed to the main shaft 230 on the outside of the mechanism 200, and the gate support arm 134 is coupled to the roadway gate arm 132. Thus, motion/rotation of the main shaft 230 facilitates lowering and raising of the gate arm 132.

The control unit 216 comprises a printed circuit board (PCB) 218 with the necessary electronics for operating and controlling the gate mechanism 200 and associated crossing gate equipment, such as crossing gate arm(s), see for example FIG. 1. Further, the PCB 218 comprises for example display(s) 224 and/or light emitting diodes (LEDs), used for example to indicate or display status of the gate mechanism 200, such status including for example 'Power on', 'Gate Request', 'Brake On', 'Health' etc.

The enclosure 210 can be opened and closed via door or cover 220, for maintenance, repair, or other services. The cover 220 is moveable between a closed position and an open position, wherein FIG. 2 shows the cover 220 in the open position. The cover 220 is closed via hinge 250 and latch plate 222 in connection with a latch rod (not shown).

Figure 3:
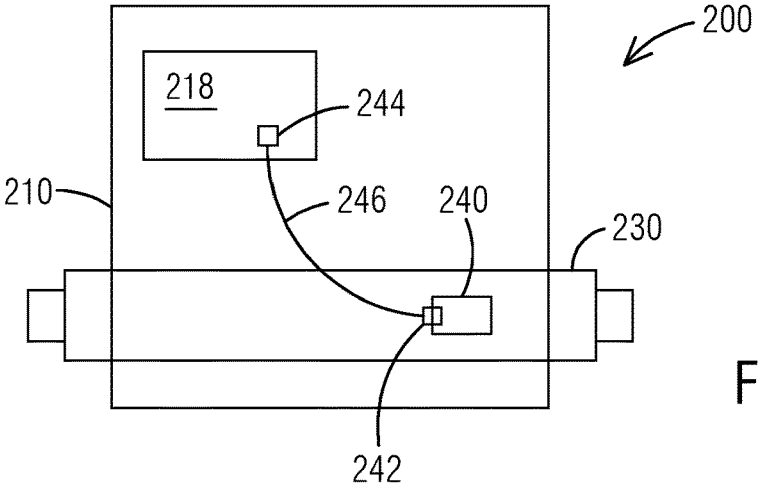
FIG. 3, FIG. 4, and FIG. 5 illustrate schematics of a crossing gate mechanisms including position detection and angle measurement in accordance with exemplary embodiments of the present disclosure.
Figure 4:
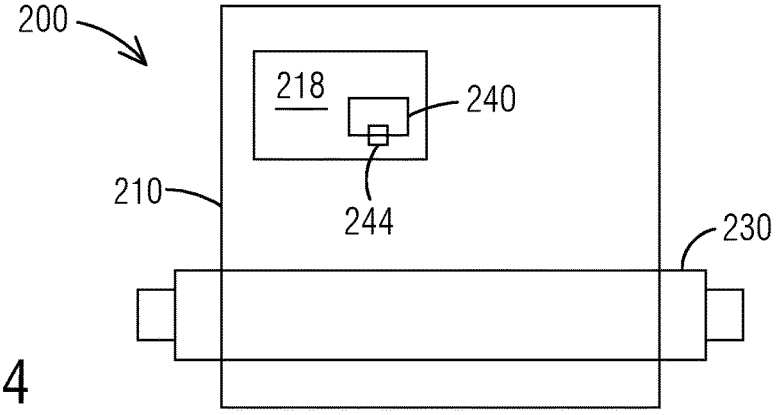
Figure 5:
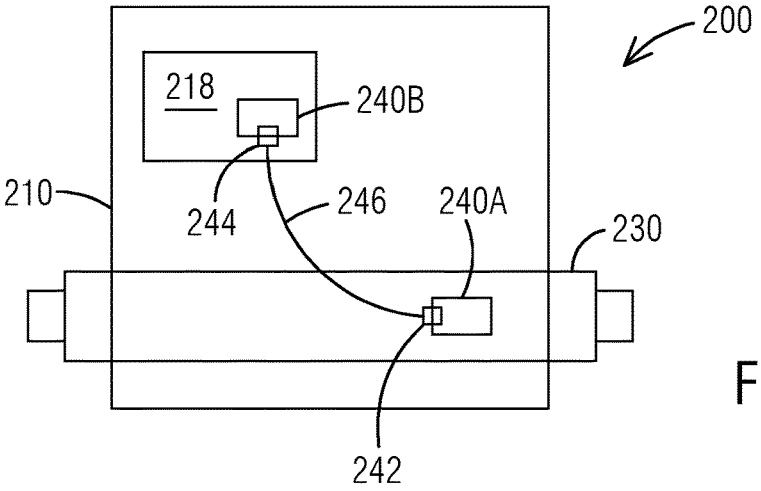

FIG. 3, FIG. 4, and FIG. 5 illustrate schematics of a crossing gate mechanism including position detection and angle measurement in accordance with exemplary embodiments of the present disclosure.

As described with reference to FIG. 2, the gate mechanism 200 comprises the enclosure 210 housing multiple mechanical, electrical, and electronic components, such as for example main shaft 230 and PCB 218 of the control unit.

The gate support arm 134 is coupled to the main shaft 230, and further the gate arm 132 is connected to the gate support arm 134 (see for example FIG. 1). The main shaft 230 is operated by the electric motor 214, e. g. gearmotor via gearing 212. As shown, the main shaft 230 extends outside the housing/enclosure 210 so that the gate support arm 134 can be coupled to the main shaft 230.

Currently, with respect to a gate arm angle, mechanical components, e. g. relays with adjustable cams, determine up and down gate positions; however, resolution is limited and fixed during installation. Moreover, determination of angles between fixed trip points is not known. Thus, it is desirable to provide detection and determination of angles as well as enclosure orientation in order to improve the gate mechanism 200.

In exemplary embodiments of the present disclosure, the gate mechanism 200 provides position detection, including detection of gate arm angle and/or enclosure orientation. More specifically, the crossing gate mechanism 200 comprises at least one electronic sensor 240 capable of providing angular information, and a processing unit 244 configured to determine position(s) based on the angular information.

For example, by way of such detection and determination of gate arm angle and enclosure orientation, it is possible to determine whether the gate arm 132, 142 is in correct positions, i. e. whether the gate arm 132, 142 is in the proper gate arm up or gate arm down position, and positions in between, or whether the main shaft 230 needs adjustment. Similarly, it is possible to determine whether gate mechanism 200 itself is correctly oriented and installed or whether it needs adjustment. Incorrect alignment or orientation of the gate mechanism 200 may lead to incorrect gate arm up/down positions.

In the embodiment described with reference to FIG. 3, the at least one electronic sensor 240 is mounted to the main shaft 230. In an example, the at least one electronic sensor 240 is positioned inside the enclosure 210 and mounted to the main shaft 230. The processing unit 244 is configured to determine crossing gate arm positions based on the angular information provided by the electronic sensor 240.

In the embodiment described with reference to FIG. 4, the at least one electronic sensor 240 is positioned inside the enclosure 210 and mounted to the enclosure 210 or to one of the multiple components in the enclosure 210. In an example, the electronic sensor 240 is mounted on the PCB 218 of the gate mechanism 200. The processing unit 244 is configured to determine an enclosure orientation based on the angular information, provided by the electronic sensor 240. In another example, the processing unit 244 may not be separate, but its functionality incorporated into the PCB 218.

In the embodiment described with reference to FIG. 5, the gate mechanism 200 comprises more than one electronic sensor, in particular first sensor 240A and second sensor 240B. The first sensor 240A provides angular information with respect to the gate arm 132, 142 via the main shaft 230, to which the sensor 240A is mounted. The second sensor 240B provides angular information with respect to the enclosure 210 or gate mechanism/box 200 itself.

With reference to FIG. 3, FIG. 4 and FIG. 5, the processing unit 244 and the one or more sensors 240, 240A, 240B are communicatively coupled, wherein the processing unit 244 is configured to receive the measurement information from the sensors 240, 240A, 240B.

In an example, as illustrated in FIG. 3 and FIG. 5, the processing unit 244 and the at least one sensor 240, 240A are configured to communicate via a wired connection 246. The connection 246 can be a serial data connection to the processing unit 244 and/or PCB 218 (in case the processing unit 244 is integrated into the PCB 218) for the purpose of providing the rotation angle (angular information) of the main shaft 230. The main shaft 230 has a potential rotation of 0 to 90 degrees. The processing unit 244 is configured to receive the angular information, calculate an angle of the crossing gate arm 132, 142 and determine, based on a calculated angle, multiple positions of the gate arm 132, 142.

In another example, the processing unit 244 and the sensors 240, 240A, 240B are configured to communicate wirelessly, for example by way of short range communication networks, such as Bluetooth, UWB, Wi-Fi, ZigBee and IR.

The sensors 240, 240A, 240B comprise input/output (I/O) connections 242. I/O connections 242 include input connections such as a power source and a clock, and output connections such as measurement data, e. g. angular information.

The electronic sensors 240, 240A, 240B each comprise an accelerometer or gyroscope. An accelerometer measures acceleration due to movement and gravity. Raw accelerometer data is collected and stored for example as acceleration values in $m/s^2$ in sample sets for each axis x, y, z together with timestamps of measured accelerations.

More specifically, the sensors 240, 240A, 240B are configured as a 3-axis accelerometer. An angle of the main shaft 230 and thus the gate arm 132, 142 can be calculated based on 2 out of the 3 axes of the 3-axis accelerometer.

In other embodiments, the electronic sensors 240, 240A, 240B may include a magnetometer (e. g. compass), a global positioning system (GPS) receiver or a global navigation satellite system (GNSS) receiver.

In another embodiment, the processing unit 244 is configured to display information provided by the electronic sensors 240, 240A, 240B and/or calculated arm angle(s), for example via display 224 of the gate mechanism (see FIG. 2) or a separate display.

With respect to the gate arm angle detection, the sensor 240, 240A, 240B, configured as 3-axis accelerometer, provides continuous resolution below tenths of a degree over a span of potential arm movement providing information for speed/position control, arm position reporting and diagnostic analysis.

Regarding an enclosure orientation of the gate mechanism 200, currently no diagnostics exist for this type of detection. However, this information provides users with an indication of how "level" the enclosure is with respect to earth and readings over time provide an indication whether the enclosure orientation has significantly changed warranting some further investigation.

The invention claimed is:

1. A crossing gate mechanism comprising:
an enclosure housing multiple components including a control unit configured to operate the crossing gate mechanism and associated crossing gate arm,
an electric motor driving a main shaft, the main shaft extending outside the enclosure and the crossing gate arm being coupled to the main shaft,
at least one electronic sensor comprising a 3-axis accelerometer mounted to the main shaft and positioned inside the enclosure, the 3-axis accelerometer configured to provide angular information, and
a processing unit configured to determine positions based on the angular information and to calculate crossing gate arm angles based on acceleration data from the 3-axis accelerometer.

2. The crossing gate mechanism of claim 1,
wherein the at least one electronic sensor is mounted to the main shaft, and
wherein the processing unit is configured to determine crossing gate arm positions including crossing gate arm angles based on the angular information.

3. The crossing gate mechanism of claim 2,
wherein the at least one electronic sensor is positioned inside the enclosure and mounted to the main shaft.

4. The crossing gate mechanism of claim 1,
wherein the at least one electronic sensor is positioned inside the enclosure and mounted to the enclosure or to one of the multiple components in the enclosure, and
wherein the processing unit is configured to determine an enclosure orientation based on the angular information.

5. The crossing gate mechanism of claim 1,
wherein the control unit comprises a printed circuit board (PCB), and
wherein the processing unit is incorporated in the PCB.

6. The crossing gate mechanism of claim 1,
wherein the processing unit and the at least one sensor are communicatively coupled to each other.

7. The crossing gate mechanism of claim 6,
wherein the processing unit and the at least one sensor are configured to communicate via a wired connection.

8. The crossing gate mechanism of claim 6,
wherein the processing unit and the at least one sensor are configured to communicate wirelessly.

9. The crossing gate mechanism of claim 1,
wherein the at least one sensor comprises an accelerometer, and/or gyroscope and/or magnetometer.

10. The crossing gate mechanism of claim 1,
wherein the processing unit is configured to receive the angular information, calculate an angle of the crossing gate arm, and determine, based on a calculated angle, multiple positions of the gate arm.

11. The crossing gate mechanism of claim 1,
wherein the processing unit is configured to display the calculated angle.

12. A crossing gate system comprising:
one or more crossing gate arm(s), and
a crossing gate mechanism comprising:
an enclosure housing multiple components including a control unit configured to operate the crossing gate mechanism and associated crossing gate arm,
an electric motor driving a main shaft, the main shaft extending outside the enclosure and the crossing gate arm being coupled to the main shaft,
at least one electronic sensor comprising a 3-axis accelerometer mounted to the main shaft and positioned inside the enclosure, the 3-axis accelerometer configured to provide angular information, and
a processing unit configured to determine positions based on the angular information and to calculate crossing gate arm angles based on acceleration data from the 3-axis accelerometer.

13. The crossing gate system of claim 12,
wherein the crossing gate mechanism comprises
a first electronic sensor mounted to the main shaft, and
a second electronic sensor mounted to the enclosure,
wherein the processing unit is configured to determine
crossing gate arm positions based on the angular information from the first electronic sensor, and
enclosure orientation based on the angular information from the second electronic sensor.

14. The crossing gate system of claim 13,
wherein the first electronic sensor and second electronic sensor comprise 3-axis accelerometers.

15. The crossing gate system of claim 13,
wherein processing unit is incorporated in a printed circuit board (PCB) of the control unit.

* * * * *